United States Patent [19]

Ohlsson et al.

[11] Patent Number: 4,632,854

[45] Date of Patent: Dec. 30, 1986

[54] WEB OF PACKAGING MATERIAL WITH A SHEET OF PLASTICS

[75] Inventors: Ingemar Ohlsson, Malmö, Sweden; Finn T. Madsen, Birkeröd; Steffen Kjaerbye, Farum, both of Denmark

[73] Assignee: Tetra Pak Developpement S.A., Pully-Lausanne, Switzerland

[21] Appl. No.: 740,014

[22] Filed: May 31, 1985

[30] Foreign Application Priority Data

Jun. 2, 1984 [DE] Fed. Rep. of Germany ..... 3420622

[51] Int. Cl.[4] ..... B31B 1/16; B32B 3/04

[52] U.S. Cl. ..... 428/36; 428/124; 428/200; 428/211; 493/224; 493/439

[58] Field of Search ..... 493/210, 224, 343, 439; 156/203, 302; 428/124, 195, 200, 211, 36, 35

[56] References Cited

U.S. PATENT DOCUMENTS 2,259,866 10/1941 Stokes ..... 493/210

2,260,064 10/1941 Stokes ..... 156/203

3,744,383 7/1973 Finch et al. ..... 493/210

4,063,641 12/1977 Kuehn et al. ..... 428/200

*Primary Examiner*—John E. Kittle

*Assistant Examiner*—James J. Seidleck

*Attorney, Agent, or Firm*—Paul & Paul

[57] ABSTRACT

A web of packaging material made of heat sealable plastic sheeting has two parallel rows of cover portions sealed to the outer surface of the sheeting and arranged eccentrically to the longitudinal center of the web. The cover portions are made of a material which is stiffer than the plastic sheeting and which can be welded to it, preferably plastic coated cardboard or paper. Each cover portion is of approximately equal size and shape and are equally spaced longitudinally along the web. At least one row of cover portions is preferably sealed to the plastic sheeting by an inner cover strip at a surface eccentric to the geometric center of the cover portion and includes a ring pull to facilitate the opening of a subsequently formed package. In an alternate embodiment, only one row of cover portions is sealed to the outer surface of the web along the longitudinal center.

9 Claims, 8 Drawing Figures

Figure 1:
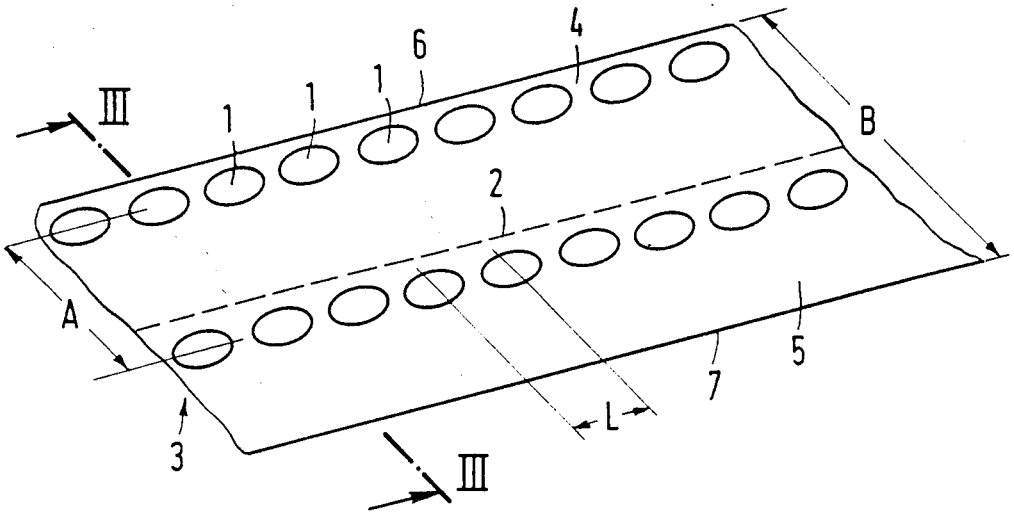

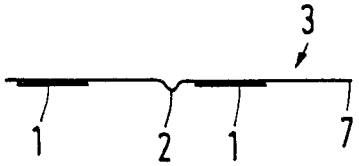
Fig.3
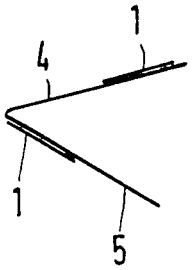
Fig.4
Fig.5
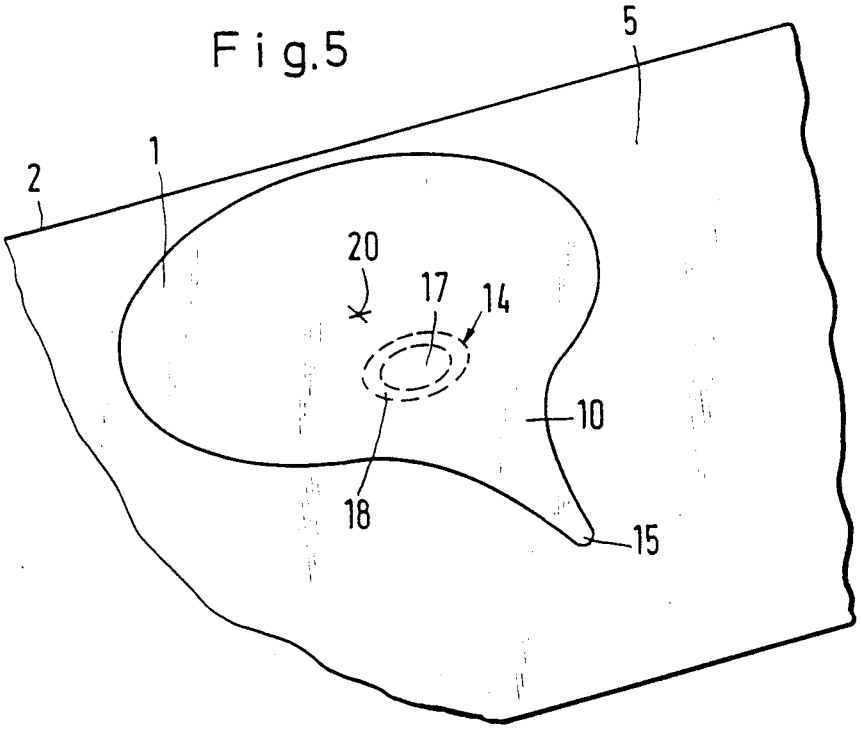

Fig.6
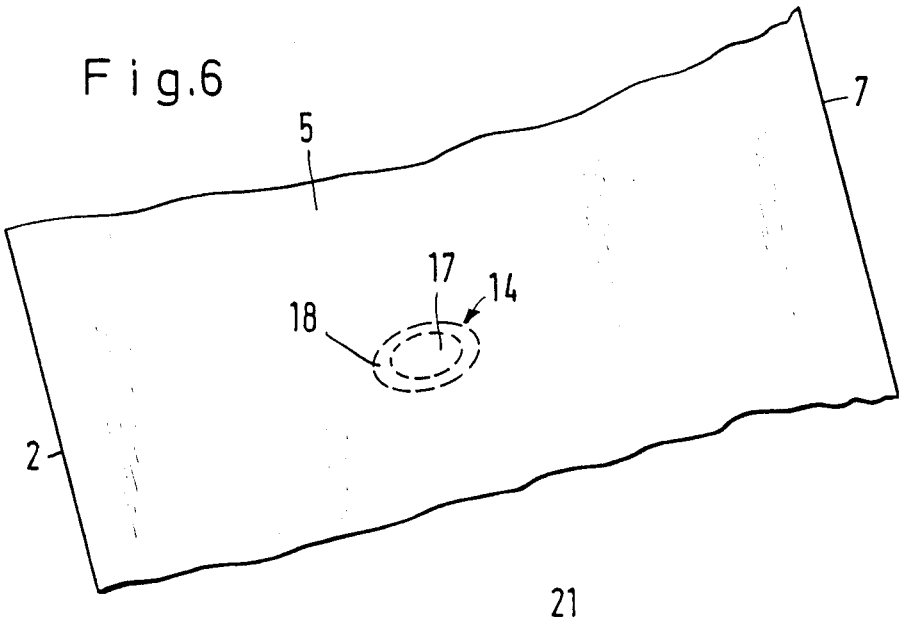
Fig.7
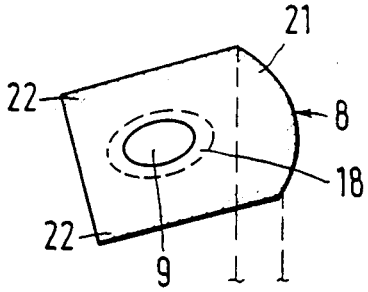
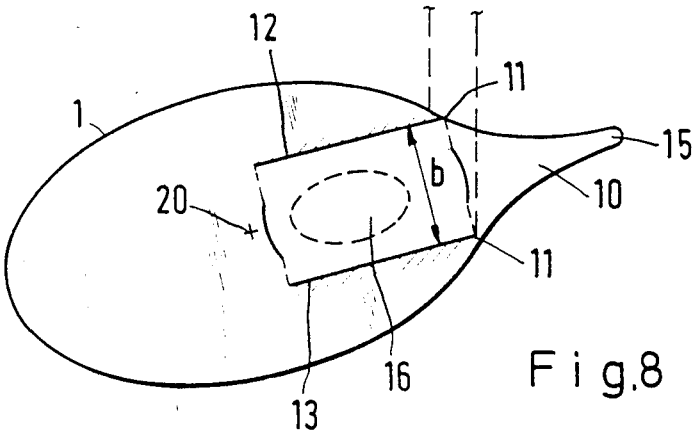
Fig.8

WEB OF PACKAGING MATERIAL WITH A SHEET OF PLASTICS

The invention relates to a web of packaging material with a sheet of plastics, which can preferably be folded over, filled and closed by sealing to form liquid packs. A bag of this type filled with liquid is placed in a supporting pack and marketed in that form.

It relates particularly to a web of packaging material made of heat sealable plastic sheeting, which is folded at a longitudinal center line to form a tube shape, in such a way that the two resultant web halves are superimposed and cover one another.

Similar webs of packaging material are known, which consist only of a sheet of plastics and which are folded along a central line to form a tube. The tube from these known webs is closed by heat sealing at two of the three still open sides, filled with the filling material, preferably liquids such as milk or juices, then the filled component bag is severed from the entire tube and completely sealed. Such bags come onto the market with or without covering cartons. In the embodiment without covering cartons the end consumer uses pouring vessels which engage around and support the tube of liquid. In the other embodiment the tube of liquid is surrounded and supported by a folded carton and marketed in that form.

The known protective box is generally parallelepipedal in shape and requires a relatively large manufacturing outlay for forming, shaping and sealing the cardboard walls and the base and lid. In addition the filled liquid bag requires careful handling and special equipment to insert it in the carton while the latter is open at at least one side.

Although attempts have been made to form a connection between the plastic bag to be filled and the supporting carton in the region of the side walls, mass production has not so far been possible because of the complexity of the manufacturing and filling machines.

The invention therefore aims to provide a web of packaging material made of heat sealable plastic sheeting, from which filling bags can be made so as to facilitate the operation of filling, sealing and covering, particularly in mass production with a large number of items being produced per unit of time.

According to the invention this aim is achieved, in that a row of cover portions of approximately equal size, made of a material which is stiffer than the sheeting and which can be welded to it, is sealed onto the outer surface of at least one web half in the direction of the longitudinal center line, with equal longitudinal spacings between the cover portions. The invention initiates a new method, namely of attaching cover portions to a sheet of plastics in rows, giving a web of material which is favorable to process, which can be processed in a packing and filling machine by simple measures, and which can be provided with a supporting cover which is far cheaper to manufacture and mount than are the known folded boxes. For example, a row of cover portions may be arranged on one of the two web halves and arranged preferably in the center thereof or symmetrically. It is desirable for the row to be sealed onto the outer surface of each web half.

In accordance with the invention it is also advantageous for the row of cover portions to be sealed onto the plastic sheeting off center at the side of the web half. If a tube is then to be formed from the web according to the invention, the first stage in the process is the above-mentioned folding at the longitudinal center line of the web, so as to make two half webs. The above-mentioned rows of cover portions run lengthwise of these half webs. The two rows correspond with one another, in that identical cover portions are provided in the transverse direction of the web. In other words, if a line is drawn through the center of a cover portion, extending across the longitudinal center line of the web, then it will also pass through the center of the cover portion in the other row. Thus in the transverse direction of the web the cover portions and the gaps between them match the opposing ones. This makes it possible to make transverse seams in the region of the gaps between the cover portions, so as to produce appropriate plastic bags. In the case of an elongated bag, one side can be thought of as being formed by part of the fold joining the two halves of the web, at the opposite end (the lid or base side) part of the longitudinal seam in the tube made from the web as forming the end of the bag, and the two above-mentioned transverse seams as forming the respective longitudinal seals.

With the off center arrangement of the row in the respective side region of the web half, though, the lid and base ends of the resultant bag are not formed directly by the fold and by the piece of tube seam as mentioned above; instead they are formed by adjacent areas of sheeting.

In accordance with the invention it is particularly desirable for the row of cover portions on a first half of the web to extend longitudinally in the region adjacent the free longitudinal edge, and for the row on the second half to extend longitudinally adjacent the fold formed by the longitudinal center line. The displacement of the web will be clarified in the following description; as a result of it the areas near the relevant cover portion form the base or lid ends of the plastic pack or bag which is ultimately required.

The advantage of the web described above with the row of cover portions in the side areas or adjacent the marginal lines of the particular half web is the ease of transport from the storage location in a filling or packaging machine, through the welding stations to the final processing section. The off center arrangement of the rows in accordance with the invention enables the web to be stored flat prior to use and transported and treated by rollers like a normal web of material, although it has cover portions sealed onto it.

It is particularly advantageous for the web of packaging material according to the invention to be stored in zigzag form and not in roll form. A finished web of this type can be withdrawn just as simply as if it were wound onto a reel. The latter is inappropriate when there are cover portions sealed onto the web because of the different thicknesses of material.

In a further advantageous embodiment of the invention each cover portion is substantially round or polygonal, preferably circular and is made of plastic coated cardboard or paper, to form the lid or base of a tubular pack of appropriate cross section. The desired liquid packs are, for example, of tubular shape with a flat lid and base. If the side walls (the tube) and the lid and base are made of plastic coated cardboard or paper, the plastic coating can be very thin and economical, particularly when the liquid is itself held in a plastic bag. To obtain the maximum possible benefit from the volume being transported, a liquid pack of this type should be filled to the optimum, i.e. completely. In such a case the plastic bag should lie closely against both the side surfaces and the lid and base of the pack. With an appropriately designed machine all these advantages are obtained, provided that the above type of web is used. The cover portions in the rows on the web halves can obviously have the above-mentioned shape. In accordance with the invention it is particularly desirable for each cover portion in at least one of the two parallel rows to be joined to the web by a sealing area arranged eccentrically to the cover portion. Provided that the whole surface of that portion lies on the web surface, which preferably lies flat during transportation, the sealing surface may be provided anywhere within the area of the cover portion. The off center arrangement of the sealing surface relative to the center of the lid portion provides the further advantage of a favorable opening arrangement using extremely simple means.

In an advantageous form of such an arrangement according to the invention, an inner cover strip, overlapping the sealing surface on the cover portion, is arranged between the web and the cover portion and welded to both. When such a strip is appropriately designed there are favorable opportunities for opening the pack, sharp pouring edges and good possibilities for pouring out, with air flowing in at the correct places to avoid gurgling in the pouring out process.

The formation of a precise pouring hole is facilitated, particularly when according to the invention, the inner cover strip has a hole inside the sealing area, through which is formed a central partial sealing area directly between the cover portion and the web. The above-mentioned sealing surface between the cover portion and the web is thus divided into a central partial sealing surface, forming the direct connection between the cover portion and the web, and an annular sealing surface surrounding it, with the inner cover strip located in this region, between the actual outer cover portion itself and the web. But since the strip virtually belongs to the cover portion, generally speaking one can speak of a cover portion even when one is referring to one with an inner cover strip.

The opening process with a cover portion attached to the web according to the invention is particularly favorable when a ring pull projects radially outwards at the periphery of the cover portion next to the sealing surface, and two parallel lines of incision are made, at a spacing from one another, each running outside and adjacent a line connecting the tip of the ring pull with the center of the portion, to form a tear-off strip in the cover portion. The provision of a ring pull facilitates the opening process for the end consumer and does not interfere with the desired properties of the web according to the invention, since projections at the periphery of the cover portion, on web halves which lie substantially flat during transportation are no trouble at all either in the turning over, folding, welding, severing or filling process. If substantially circular cover portions are chosen they can very economically be punched out of a large web of paper if the ring pulls are provided with them at the edge. Remnants of material are left between the individual circles in the web and, if arranged correctly, they can just form the ring pull. A favourable method of tearing or opening a liquid pack is derived naturally from the ring pull. If it is arranged externally at the periphery of a lid, the opening method is to pull up the ring pull radially towards the centre of the lid. The above-mentioned parallel incisions, extending approximately into the central region of the cover portion, are provided to aid in and guide the tearing process. The incisions and cover strip are obviously only ever provided on the cover portion on one half of the web which will form the lid of a pack with the opening device. The opposing cover portion on the other half of the web only forms the base, which does not have the opening device.

Figure 2:
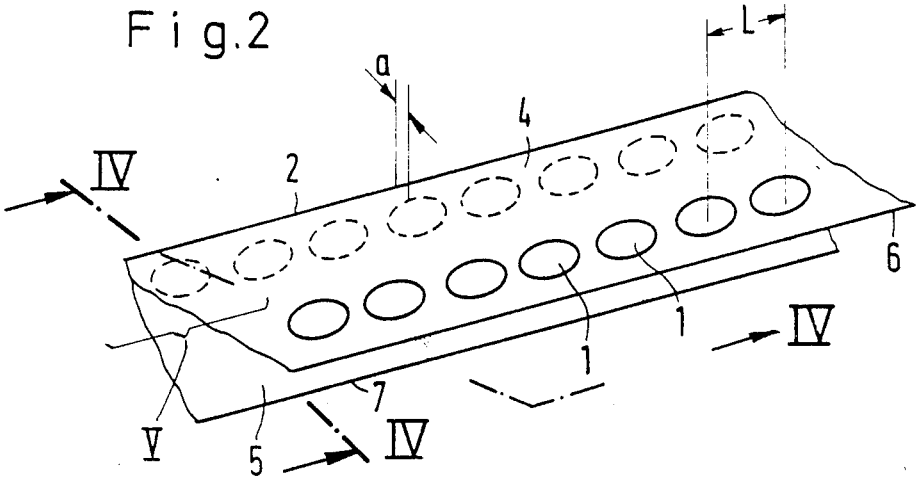

Other advantages, features and applications of the invention will emerge from the following description in conjunction with the drawings, which show a preferred embodiment. In these:

FIG. 1 is a perspective view of a fragmentary part of the web of packaging material with the two rows of cover portions, FIG. 2 is a larger scale perspective view of the two halves of the web, folded along the longitudinal centre line of the web so that one covers the other, with the attached rows of cover portions, FIG. 3 is a diagrammatic sectional view along the line III—III in FIG. 1, FIG. 4 is a diagrammatic sectional view along the line IV—IV in FIG. 2, FIG. 5 is a still larger scale plan view of the lower half of the web in the region V in FIG. 2, but here showing the ring pull which is omitted from the diagrammatic representation in FIG. 2, and FIGS. 6 to 8 show the subject of FIG. 5 in an exploded, more concrete form where further details are given; FIG. 6 represents the web of sheeting, FIG. 7 the inner cover strip and FIG. 8 the actual cover portion in the form of a lid.

The web of packaging material is shown in the flat state in FIG. 1. It comprises a heat sealable sheet of plastics with cover portions 1 welded onto it. FIGS. 1 and 3 show the longitudinal center line of the web, which is referred to generally as 3. In order to form a tube shape the web can be folded over the center line 2 into the state shown in FIGS. 2 and 4, producing two web halves 4 and 5.

Although the beginning and end of the web 3 are not defined as seen in a longitudinal direction, the first half 4 of it is bounded at one side by the fold formed by the longitudinal center line 2 and at the other side by the free longitudinal edge 6. The other, second half 5 is similarly bounded by the center line 2 and free outer edge 7.

It will be seen clearly from FIGS. 3 and 4 that the cover portions 1 are each arranged on the external surface of the web halves 4 and 5. FIGS. 2 and 4 show particularly clearly that the surfaces in question with the cover portions are arranged externally, while the liquid is received inside the subsequent tube.

The cover portions 1 are mounted in the form of rows which contain them at equal longitudinal spacings L, off-center at the side of each web half 4 and 5. A distance a will also be seen (FIG. 2) between the periphery of a cover portion 1 and the edge of the web half, here the center line 2 of the first half 4. If the total width B of the web 3 is 56 cms, the distance A between the two rows of cover portions 1 will be approximately 28 cms, the distance L between pairs of cover portions 1 in the direction of the rows will then be 13 cms and the above-mentioned distance a from the edge will be 0.8 cm.

The cover portions 1 shown in FIGS. 1, 2 and 5 appear oval, but they are circular in plan. The cover portion 1 located in region V under the lower half 5 of the web in FIG. 2 is to form a lid in the subsequent pack and therefore has the opening device. The portion 1 is shown more clearly in FIGS. 5 to 8. The second, lower half 5 of the web can be seen from FIGS. 5 and 6. It is bounded by the longitudinal center line 2 at the left and by the free longitudinal edge 7 at the right, while lengthwise of the web the ends are broken off and not defined. One is so to speak looking through the web 5 onto the sealing surface, defined generally as 14, whereby the web 5 is joined to the cover portion 1 with an inner cover strip 8. The sealing surface is made up of two part surfaces, namely the central part 17 and the outer surface 18 encircling it. The exploded view in FIGS. 6 to 8 shows clearly that the viewer of figure 5 is looking through the lower web 5 onto the inner cover strip 8 and then onto the cover portion 1 below it.

The inner cover strip 8 contains a central hole 9. When the web 5 is being sealed onto the actual layer of material of the cover portion 1, it is through this hole that the central partial sealing surface 17 comes directly into contact and into a bonded relationship with the cover portion in the central hatched region 16 in FIG. 8.

At the periphery of the cover portion 1 in FIGS. 5 and 8, next to the sealing surface 14, a ring pull 10 is shown projecting radially outwards in front and to the right. Two parallel lines of incision 12 and 13 start at the points 11 where the ring pull 10 merges into the periphery of the cover portion 1 and extend inwardly to the central region of the portion 1, the distance b between them being the distance between the two points 11. The incisions extend outside an imaginary connecting line (not shown), which should be thought of as running between the tip 15 of the ring pull and the center 20 of the cover portion 1.

The curved outer part of the inner cover strip 8 (the part at the right hand side of FIG. 7) is sealed onto the end edge of the tube (not shown) along the welded seam 21, and the strip 8 is welded to the inside of the cover portion 1 at the seams 22, which extend a short distance outside the parallel incisions 12 and 13.

It will be appreciated that the cover 1 is appropriate and simple in design; in some cases it may have an inner cover strip 8 welded onto it, enabling large numbers of cover portions 1 to be placed on webs of sheeting 4 and 5 to form a web of packaging material which is easy to change in direction, store and process.

In another possible embodiment, which is not illustrated, the cover portions are arranged symmetrically in the center of the web of material, in *one* row only instead of the two parallel rows shown in the drawings. In cases where there is only one row on only one half of the web the cover portion may e.g. be used as the base, while the other closure or the top closure can be mounted separately in a subsequent operation.

We claim:

1. A web of packaging material made of heat sealable plastic sheeting with a longitudinal center line which can be folded at the longitudinal center line in such a way that the two resultant web halves are superimposed and cover one another, characterized in that a row of cover portions of approximately equal size, made of a material which is stiffer than the sheeting and which can be welded to it, is sealed onto the outer surface of each web half in the direction of the longitudinal center line, with equal longitudinal spacings between the cover portion, and further characterized in that the rows of cover portions are arranged eccentric to the longitudinal center of the web.

2. The web of claim 1, characterized in that on a first web half the row of cover portions extends longitudinally in the region adjacent the free longitudinal edge, while on the second web half it extends longitudinally in the region adjacent the longitudinal center line.

3. The web of claim 1, characterized in that each cover portion is substantially round or polygonal, preferably circular and is made of plastic coated cardboard or paper, and forms the lid or base of a tubular pack of appropriate cross section.

4. The web of claim 1, characterized in that at least one of the two parallel rows of cover portions is joined to the web of sheeting at a sealing surface arranged eccentrically to the geometric center of the cover portion.

5. The web of claim 4, characterized in that an inner cover strip, overlapping the sealing surface on the cover portion, is arranged between the web and the cover portion and welded to both.

6. The web of claim 5, characterized in that the inner cover strip has a hole inside the sealing surface, through which is formed a central partial sealing area directly between the cover portion and the web.

7. The web of claim 6, characterized in that a ring pull projects radially outwards at the perphery of the cover portion next to the sealing surface, and two parallel lines of incision are made, at a spacing from one another, each running outside and adjacent a line connecting the tip of the ring pull with the center of the cover portion, to form a tear-off strip in the cover portion.

8. A web of packaging material made of heat sealable plastic sheeting with a longitudinal center line which can be folded at the longitudinal center line in such a way that the resultant web halves are superimposed and cover one another, characterized in that a row of cover portions of approximately equal size, made of a material which is stiffer than the sheeting and which can be welded to it, is sealed onto the outer surface of at least one web half in the direction of the longitudinal center line with equal longitudinal spacings between the cover portions, and further characterized in that each cover portion is substantially round or polygonal, preferably circular and is made of plastic coasted cardboard or paper, to form the lid or base of a tubular pack of appropriate cross section, and wherein each cover portion in at least one row is joined to the web of sheeting by a sealing surface arranged eccentrically to the cover portion, wherein an inner cover strip overlapping the sealing surface on the cover portion is arranged between the web and the cover portion and welded to both, and wherein the inner cover strip has a hole inside the sealing area through which is formed a central partial sealing area directly between the cover portion and the web.

9. The web of claim 8, characterized in that a ring pull projects radially outwards at the perphery of the cover portion next to the sealing surface, and two parallel lines of incision are made, at a spacing from one another, each running outside and adjacent a line connecting the tip of the ring pull with the center of the cover portion, to form a tear-off strip in the cover portion.

* * * * *